US006935065B1

(12) United States Patent
Oliver

(10) Patent No.: US 6,935,065 B1
(45) Date of Patent: Aug. 30, 2005

(54) GUN SUPPORT

(76) Inventor: John W. Oliver, 3877 Lower Elkton Rd., Leetonia, OH (US) 44431

( * ) Notice: Subject to any disclaimer, the term of this patent is extended or adjusted under 35 U.S.C. 154(b) by 0 days.

(21) Appl. No.: 10/913,056

(22) Filed: Aug. 5, 2004

(51) Int. Cl.[7] ..... F41A 29/00
(52) U.S. Cl. ..... 42/94; 211/64; 248/156; 248/161; 248/530
(58) Field of Search ..... 42/94; 211/64; 248/156, 161, 530

(56) References Cited

U.S. PATENT DOCUMENTS

| | | | | |
|---|---|---|---|---|
| 3,007,581 A | | 11/1961 | Moore | |
| 3,477,586 A | | 11/1969 | Haluska | |
| 3,876,078 A | | 4/1975 | Gomes et al. | |
| 3,917,071 A | | 11/1975 | Walters | |
| 3,952,878 A | | 4/1976 | Gorham | |
| 4,089,423 A | | 5/1978 | Gorham et al. | |
| 4,144,971 A | | 3/1979 | Balibrea | |
| 4,271,969 A | | 6/1981 | Gnesa | |
| 4,318,567 A | | 3/1982 | Guthier | |
| 5,345,706 A | * | 9/1994 | Brown | 42/94 |
| 5,626,379 A | | 5/1997 | Scott | |
| 5,680,939 A | | 10/1997 | Oliver | |
| 5,819,462 A | * | 10/1998 | Dockery | 42/94 |
| 5,819,463 A | * | 10/1998 | Amos | 42/94 |
| 5,913,667 A | * | 6/1999 | Smilee | 42/94 |
| 5,930,931 A | * | 8/1999 | Watson | 42/94 |

* cited by examiner

*Primary Examiner*—J. Woodrow Eldred
(74) *Attorney, Agent, or Firm*—Harpman & Harpman

(57) ABSTRACT

A gun holder and support apparatus that combines multiple gun engagement functions in a compact adjustable transportable configuration. The gun support device provides for a self-supporting and portable field gun holder with adjustment brackets to accommodate different rifle gun types as well as acting as a gun barrel rest during firing.

8 Claims, 5 Drawing Sheets

GUN SUPPORT

BACKGROUND OF THE INVENTION

1. Technical Field

This invention relates to gun holders and supports that are used to support a rifle or a shotgun in a vertical storage or transportation orientation position.

2. Description of Prior Art

Prior art devices of this type have relied on a variety of different rifle engagement designs, see for example U.S. Pat. Nos. 3,007,581, 3,477,586, 3,876,078, 3,917,071, 3,952,878, 4,089,423, 4,144,971, 4,271,969, 4,318,567, 5,626,379 and applicant's own U.S. Pat. No. 5,680,939.

In U.S. Pat. No. 4,144,971 a gun caddy sling and support rod with barrel clamp on one end and a gun but engagement platform adjacent the base for engagement to the ground is shown.

U.S. Pat. No. 3,917,071 defines a weapons security rack having an elongated support channel with a gun but cap on its lower end and a barrel engagement latch adjustably positioned within the channel in spaced relation thereto.

U.S. Pat. No. 3,952,878 illustrates a gun stand with a pivoting gun tray and a barrel engagement dual clip on a telescopically adjustable main support section.

U.S. Pat. No. 4,089,423 discloses a ground engageable adjustable support rifle stand having a hinged gun rest arm and a stock rest bracket.

U.S. Pat. No. 4,271,969 shows a portable long barrel firearm stand for a rifle or shotgun having a ground engagement stake from which extends a tubular support element with an adjustable end barrel engagement rod extending therefrom.

U.S. Pat. No. 5,626,379 is drawn to a portable gun rack having a tripod leg configuration with a contoured multiple gun engagement base and a multiple notch barrel rest bracket in spaced relation thereto.

Applicant's own U.S. Pat. No. 5,680,939 discloses a basic ground engageable gun support on which the present invention is an improvement thereon.

SUMMARY OF THE INVENTION

A self-contained portable gun holder and support apparatus that utilizes multiple gun engagement functions in a single self-contained configuration for insertion into the ground or to be carried by the user. The device includes a ground engagement stake with a main support tube having a secondary gun engagement tube movably positioned therealong. The device provides for static holding of a rifle in either rest or for transportation as well as acting as a barrel rest during shooting by utilization of a rotating support element on its upper end.

DESCRIPTION OF THE PREFERRED EMBODIMENT

Figure 1:
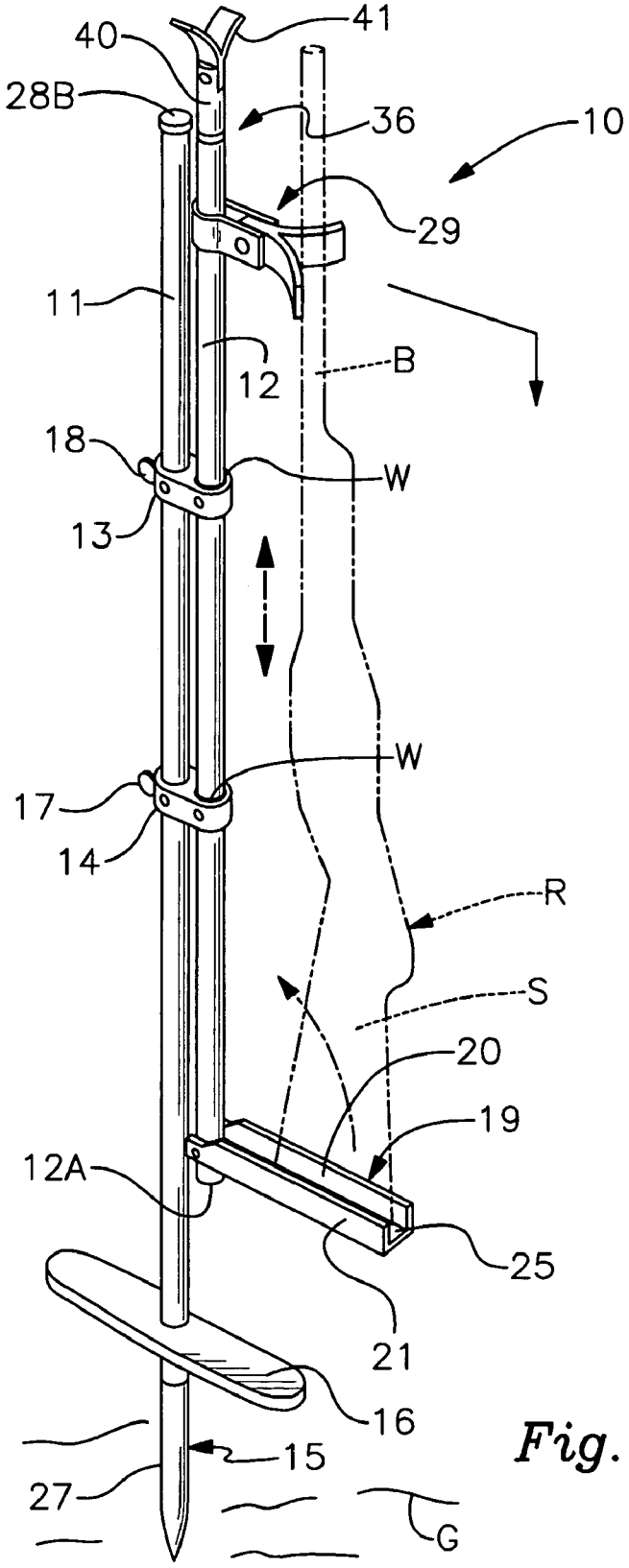
FIG. 1 is a perspective view of the improved gun support in deployed position.
Figure 6:
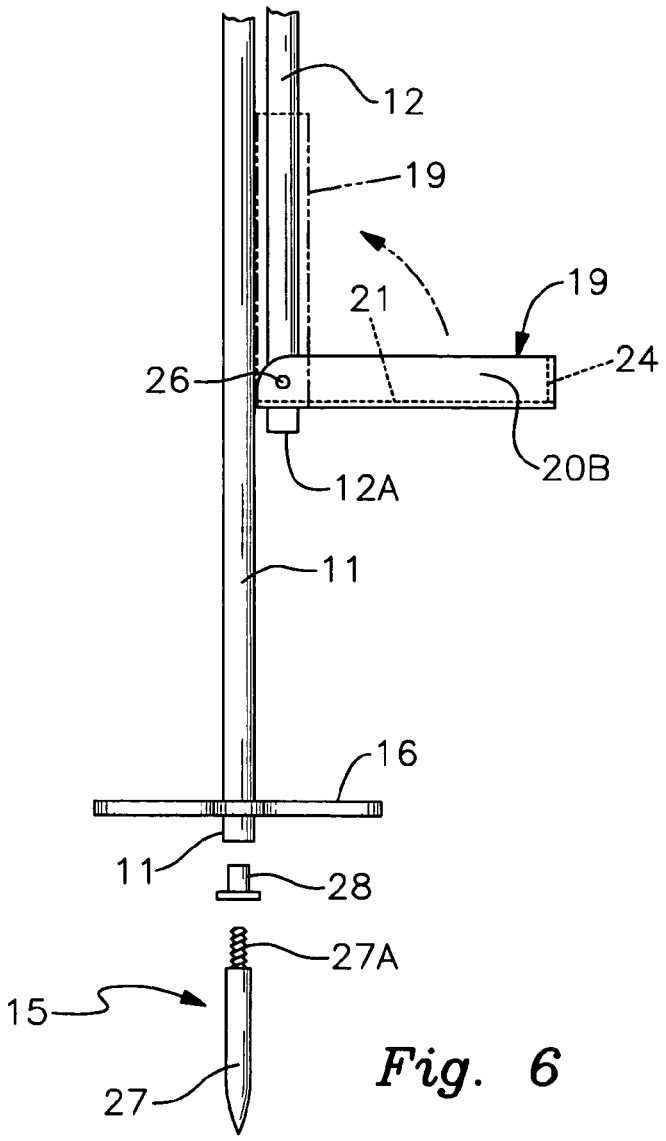
FIG. 6 is an enlarged partial side elevational view of the lower portion of the gun support device.
Figure 7:
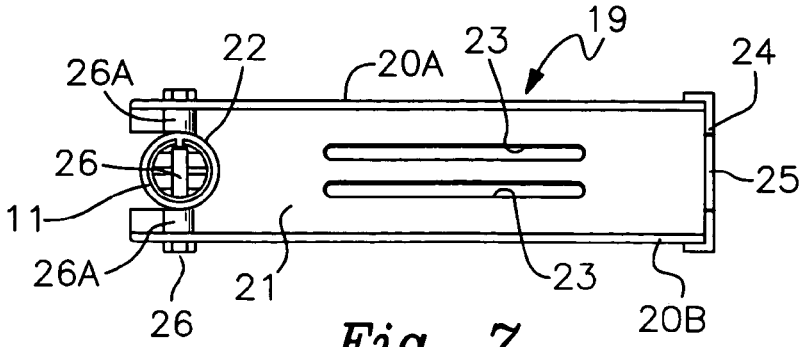
FIG. 7 is a top plan view of the gun but receiving tray and support tub.

Referring to FIG. 1 of the drawings, a gun support 10 of the invention can be seen for supporting a rifle or a shotgun R shown in broken lines within. The gun support 10 has a main support tube 11 and a parallel gun support tube 12 with a pair of interconnecting adjustable brackets 13 and 14 thereon. The brackets 13 and 14 are affixed to the gun support tube 12 and act as a guide for vertical adjustment of the gun support tube 12 in relation thereto as indicated by the directional arrows. The main support tube 11 has a removable ground engagement spike assembly 15 and a stabilization ground insert plate 16 which can be engaged by the user's foot (not shown) to aid in the insertion of the spike assembly into the ground G. The gun support tube 12 is, as noted, adjustably vertical in relation to the gun support tube 11 with the guide brackets 13 and 14 which have set bolts 17 and 18 to lock the gun support tube 12 into position. A gun stock receiving tray 19 is pivotally secured to the lower end 12A of the gun support tube 12 and is adapted to receive and support the stock S of the rifle or shotgun R. The tray 19, best seen in FIGS. 1, 6 and 7 of the drawings has spaced oppositely disposed parallel sidewalls 20A and 20B extending from a base 21 which has a U-shaped notch at 22 for engagement about the main tube 11 prior to deployment and a pair of elongated apertures at 23 for drainage are provided. An end wall 24 interconnects said respective sidewalls 20A and 20B also have a U-shaped notch therein at 25 to accommodate the main support tube 11 when pivoted upwardly thereagainst as shown in broken lines in FIG. 6 of the drawings. The tray 19 is pivotally secured to the main support tube 11 by a pivot bolt and nut 26 extending therethrough with respective spacers 26A thereon on as seen in FIG. 7 of the drawings.

The spike assembly 15 has a ground spike 27 with a threaded end at 27A receivable into a threaded tube insert 28 within the main support tube 11 which allows for selective rotational removal of the spike 27 by the user. A second threaded tube insert 28A is positioned with the oppositely disposed free end of said main support tube 11 with a threaded end plug 28B secured therewithin.

Figure 2:
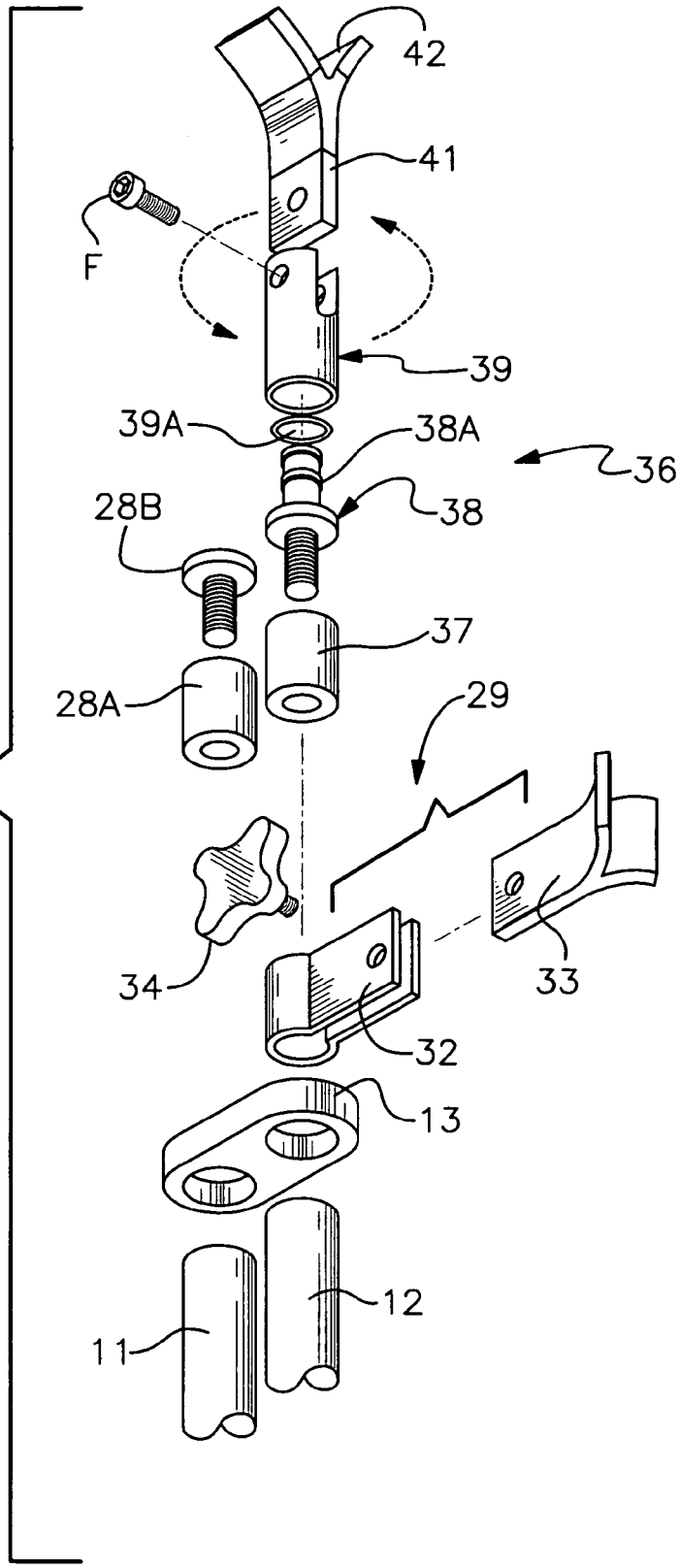
FIG. 2 is an enlarged exploded assembly view of an upper adjustable gun rest with a barrel engagement portion of the gun support of the invention.
Figure 3:
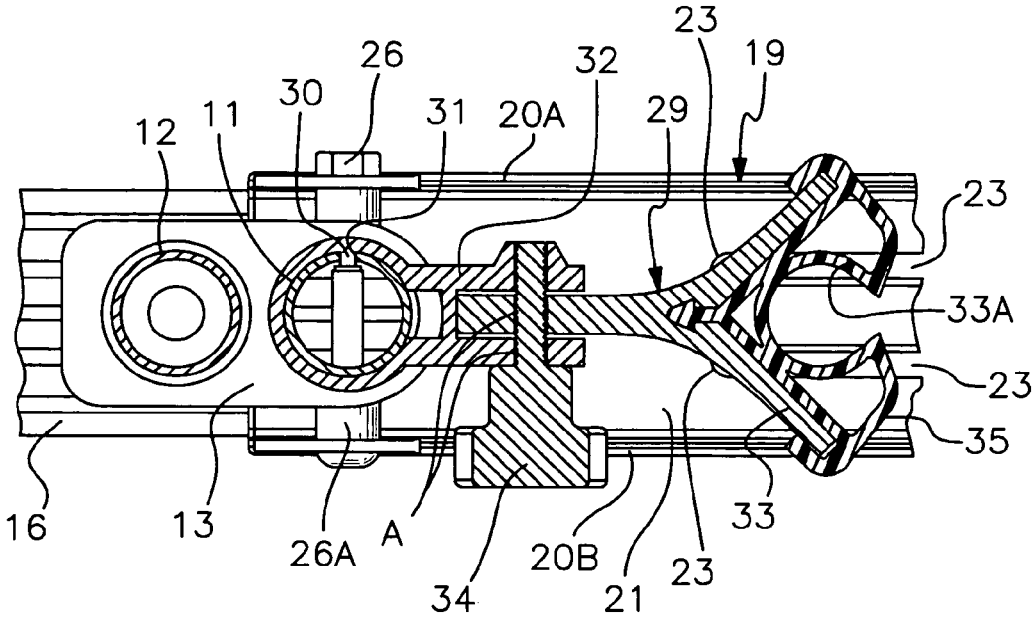
FIG. 3 is an enlarged partial cross-sectional view on lines 3—3 of FIG. 1.
Figure 5:
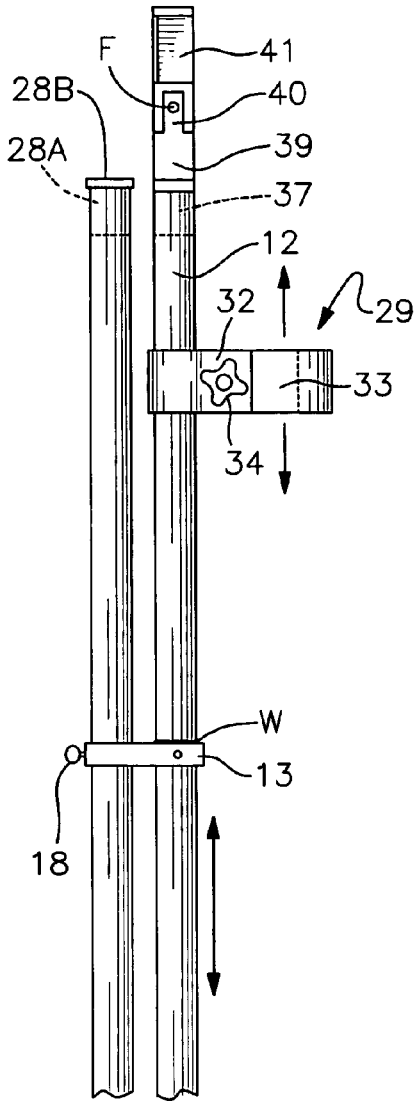
FIG. 5 is an enlarged partial side elevational view of the upper portion of the gun support device.

Referring to FIGS. 2 and 3 of the drawings, a barrel support bracket 29 assembly is adjustably positioned on the gun support tube 12 by a guide flange 30 extending inwardly therefrom for registration with an elongated channel 31 within the gun support tube 11. The bracket 29 assembly has a bifurcated clamp portion 32 for receiving a Y-shaped apertured insert 33 which extends therefrom. A lock knob 34 is threadably engaged through the aperture A in the clamp portion 32 and insert 33 allows for adjustable vertical repositioning of the support bracket 29 on the gun support tube 12 as indicated by directional arrows in FIG. 5 of the drawings.

Figure 4:
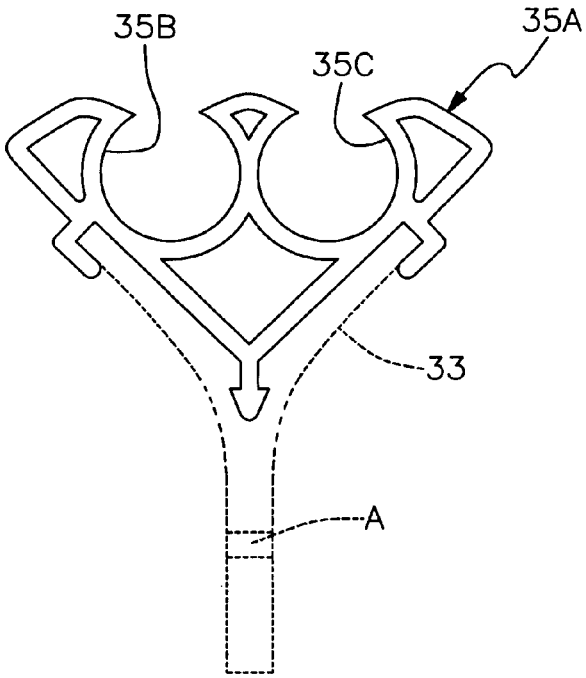
FIG. 4 is an enlarged top plan view of an alternate barrel resilient engagement support.

A resilient barrel grip fitting 35, best seen in FIG. 3 of the drawings is frictionally secured within the Y-shaped insert 33 and defines a broken annular ring surface 33A which will yieldably grip the barrel portion B of the rifle or shotgun R. An alternate barrel grip fitting 35A shown in FIG. 4 of the drawings illustrates a double barrel configuration having a pair of broken resilient annular ring surfaces 35B and 35C to accommodate such double barrels as necessary (not shown).

Referring back to FIGS. 1 and 2 of the drawings, a swivel gun rest assembly 36 can be seen extending from the upper free end of the gun support tube 12. The gun rest assembly 36 has a tube insert 37 which threadably receives a swivel post fitting 38 having an annular groove at 38A therein. A rotatable mount 39 is snap fit onto the post fitting 38 by a spring clip 39A and a washer 39B so as to be freely rotatable thereon.

The rotating mount 39 has oppositely disposed apertured bifurcated end portion 40 which receive a secondary apertured Y-shaped bracket 41 held by a fastener F. The bracket 41 has a resilient gun engagement surface at 42 onto which the gun barrel B is steadied during firing as will be well understood by those skilled in the art.

It will be seen that by utilization of the removable ground engagement spike 27 that the gun support 10 of the invention can be free standing safely and securely holding a rifle or shotgun R within. Alternately, the gun support 10 can be used as a unidirectional gun rest for firing via the rotatable mount 39 on the upper end of the gun support tube 12 as hereinbefore described. The pivoted gun stock receiving tray 19 as noted will fold up against the gun support tube 12 when not in use allowing for easy access and transportation of the gun support for use.

It will thus be seen that a new and novel improvement to a gun support has been illustrated and described and it will be apparent to those skilled in the art that various changes and modifications may be made therein without departing from the spirit of the invention.

Therefore I claim:

1. A selectively ground engageable gun support for use in supporting a long barreled gun comprises, a main support tube having a removable spike disposed in one end for insertion into the ground, a stabilization and insert foot rest on said tube adjacent said spike, a gun support tube slidably attached in parallel relation to said main support tube, a pair of guide brackets secured to said gun support tube allowing said gun support tube to be slidably adjusted vertically up and down on the main support tube, tube engagement means within said brackets, a gun but support tray pivotally secured to the end of said gun support tube, a barrel bracket adjustably positioned on said gun support tube, said barrel bracket having tube alignment means within, a gun rest freely rotatable on the free end of said upper gun support tube, and means for selectively securing said barrel bracket on said gun support tube.

2. The gun support set forth in claim 1 wherein said stabilization and insert foot rest extends at right angles to said main support tube in oppositely disposed relation thereto.

3. The gun support set forth in claim 1 wherein said main support tube is of a known length and said gun support tube is of a length less than that of said known length of said main support tube.

4. The gun support set forth in claim 1 wherein said tube engagement means within said bracket comprises, a first annular opening therein registerable about said main support tube and a second annular opening therein affixed about said gun support tube, said first annular opening selectively secured to said gun support tube.

5. The gun support set forth in claim 1 wherein said gun but support tray has oppositely disposed upstanding sidewalls, an integral base therebetween, elongated apertures within said base, a notch in said base and an end wall having a notch therein.

6. The gun support set forth in claim 1 wherein said barrel bracket tube alignment means comprises, a rib registerable within an elongated channel in said gun support tube.

7. The gun support set forth in claim 1 wherein said means for selectively securing said barrel bracket on said gun support tube comprises, a knob threadably disposed through said bracket.

8. The gun support set forth in claim 1 wherein said gun rest comprises, a Y-shaped bracket on a swivel fitting threadably secured within the upper end of said support tube.

* * * * *